US006027808A

United States Patent [19]

Aoki et al.

[11] Patent Number: 6,027,808

[45] Date of Patent: Feb. 22, 2000

[54] CEMENTED CARBIDE FOR A DRILL, AND FOR A DRILL FORMING HOLES IN PRINTED CIRCUIT BOARDS WHICH IS MADE OF THE CEMENTED CARBIDE

[75] Inventors: Yukio Aoki, Akashi; Hideto Kurata, Koto-ku; Masaru Ishii; Masahiro Machida, both of Akashi, all of Japan

[73] Assignee: Shinko Kobelco Tool Co., Ltd., Akashi, Japan

[21] Appl. No.: 08/879,789

[22] Filed: Jun. 20, 1997

[30] Foreign Application Priority Data

Nov. 11, 1996 [JP] Japan ..... 8-299085

[51] Int. Cl.[7] ..... B32B 9/00

[52] U.S. Cl. ..... 428/408; 428/323; 428/325; 428/697; 428/698; 428/699

[58] Field of Search ..... 428/408, 325, 428/323, 697, 699, 698

[56] References Cited

U.S. PATENT DOCUMENTS

| | | | |
|---|---|---|---|
| 4,731,296 | 3/1988 | Kikuchi et al. | 428/552 |
| 4,753,678 | 6/1988 | Maruyama et al. . | |
| 4,820,482 | 4/1989 | Fischer et al. | 419/15 |
| 5,009,705 | 4/1991 | Yoshimura et al. . | |
| 5,068,148 | 11/1991 | Nakahara et al. | 428/408 |
| 5,204,167 | 4/1993 | Saijo et al. | 428/408 |
| 5,286,549 | 2/1994 | Hartzell et al. | 51/309 |
| 5,370,944 | 12/1994 | Omori et al. | 428/565 |
| 5,585,176 | 12/1996 | Grab et al. | 428/698 |
| 5,653,376 | 8/1997 | Nakamura et al. | 228/51 |
| 5,716,170 | 2/1998 | Kammermeier et al. | 407/119 |

FOREIGN PATENT DOCUMENTS

| | | |
|---|---|---|
| 61-12847 | 1/1986 | Japan . |
| 61-195951 | 8/1986 | Japan . |
| 63-53269 | 3/1988 | Japan . |
| 63-20911 | 5/1988 | Japan . |
| 7-11375 | 1/1995 | Japan . |

*Primary Examiner*—Archene Turner
*Attorney, Agent, or Firm*—Oblon, Spivak, McClelland, Maier & Neustadt, P.C.

[57] ABSTRACT

The present invention has as its objective the provision of a cemented carbide (for a drill) which has excellent breakage resistance and which displays good adhesion when coated with a hard-carbon coating; as well as the provision of a drill for forming holes in printed circuit boards which is made using said cemented carbide. It is a WC-iron group metal cemented carbide having as its main component WC having an average grain size of 0.7 $\mu$m or less; containing 0.1 to 3.0 weight percent of one or more types selected from the group consisting of V, Cr, Ta and Mo; whose surface layer consists of substantially only WC or only WC grains and components other than binder phase comprising iron group metals; wherein the average grain size of the WC in the surface layer is larger than the average grain size of the WC in the interior; and wherein the Young's Modulus at the interior is 600 MPa or higher.

9 Claims, 1 Drawing Sheet

CEMENTED CARBIDE FOR A DRILL, AND FOR A DRILL FORMING HOLES IN PRINTED CIRCUIT BOARDS WHICH IS MADE OF THE CEMENTED CARBIDE

BACKGROUND OF THE INVENTION

The present invention relates to a cemented carbide useful as a material for drills whose surface is coated with a coating of hard carbon such as diamond, non-crystalline diamond etc. and which are used for forming small diameter holes in printed circuit boards (hereafter referred to as PCB drills); and to the above-described kind of PCB drill itself. The cemented carbide to which the present invention is directed can be one in which the component which forms the binder phase is not limited to Co but may also be another metal from the iron group such as nickel. However, the present invention shall be hereunder explained taking Co as a representative example of the component which forms the binder phase.

Printed circuit boards are made by binding glass fibers with epoxy resin and then attaching a film of copper on the surface thereof. In recent years, printed circuit boards are being made with higher and higher density and consisting of more and more layers. Accordingly, there has been a demand that a material for a PCB drill to drill small diameter holes has wear resistance and breakage resistance significantly higher than conventional materials.

WC-Co cemented carbides are generally used as materials for PCB drills. When WC-Co cemented carbides are used as the material for the drill, the hardness can be increased without decreasing the toughness, by reducing the size of the WC grains. From this standpoint, the cemented carbides disclosed in Japanese Patent Application Publication No. Sho 61-12847 and Japanese Patent Application Publication No. Sho 61-195951 have been proposed. In the technique disclosed in the former of these publications, V and Cr (WC grain growth inhibitors) are added simultaneously to a WC-Co cemented carbide (or WC-Ni cemented carbide) with the aim of suppressing the growth of the WC grains, and a cemented carbide having excellent wear resistance and toughness and having a dispersed phase of fine WC grains which have an average grain size of 0.7 $\mu$m or less, can be obtained. In the latter of these publications, there is disclosed a tough cemented carbide having a Rockwell hardness (HRC) of 91 or more and a transverse rapture strength of 350 kg/mm$^2$ or more which is achieved by the addition of VC, ZrN. In addition to V and Cr, Ta, Mo etc. are also known as elements for WC grain growth inhibitors (for example, see "Powders and Powder Metallurgy" 19(1972) p. 67).

On the other hand, with respect to hard carbons such as diamond, non-crystalline diamond etc., there have been advances in the development of the application thereof to cutting tools, wear-resistant parts due to their extremely high hardness and high heat conductivity. In particular, there have been vigorous advances in the development of hard carbon coated cemented carbide tools comprising a base material made of an ultra-fine grade cemented carbide having excellent toughness and a coating of hard carbon formed thereon by chemical vapor deposition.

However, there exists the following problems with the cemented carbides employed hereto as the base material for tools. The cemented carbides include about 3 to 20% of iron group elements such as Co, Ni etc., and the carbon dissolves into the binder phase during synthesis of the hard carbon coating whereby a hard film cannot be formed, or even if a hard film is partially formed, the adhesion thereof to the cemented carbide base material is not sufficient whereby the coating easily becomes peeled from the base material.

With a view to improving these problems in the prior art, the kind of technique disclosed in for example Japanese Patent Application Publication No. Hei 7-11375 has been proposed. In this technique, in order to obtain a product exhibiting excellent adhesion when the hard carbon coating is formed, there is adopted as the base material a cemented carbide in which substantially only WC grains or only WC particles and components other than binder phase comprising iron group elements are exposed on the surface, i.e. in which no iron group elements exist in the surface layer, and which fulfills at least one of the following conditions:

(a) the average grain size of WC in the surface layer is larger than the grain size in the interior;

(b) the surface hardness is higher than the hardness of the interior; A hard carbon coating is then coated onto the surface of this base material.

However, even this technology cannot be said to sufficiently display those properties required to meet the recent advances with respect to the high density and multiple layering of printed circuit boards, and there is also the problem that the drill breaks during drilling. This problem is particularly striking when a fine diameter drill having a cutting point diameter of $\phi$0.5 mm or less is used.

SUMMARY OF THE INVENTION

The present invention was made in the light of this state of the art, and has as its objective the provision of a cemented carbide for a drill which has excellent anti-breakage resistance and which exhibits good adhesion when coated with a hard carbon coating. It also has as its objective the provision of a drill for forming small diameter holes in printed circuit boards which is made of this cemented carbide.

The cemented carbide of the present invention which achieves these objectives is a WC-iron group metal cemented carbide which has as its main component WC having an average grain size of 0.7 $\mu$m or less; contains 0.1 to 3.0 weight percent of at least one type of element selected from the group of V, Cr, Ta and Mo; whose surface layer consists of substantially only WC or WC grains and components other than binder phase comprising iron group metals; wherein the average particle size of the WC in the surface layer is larger than the average grain size of the WC in the interior; and wherein the Young's Modulus of the interior of said cemented carbide is 600 MPa or more. A typical example of a cemented carbide of the present invention is one having Co as the iron group metal.

In the cemented carbide of the present invention, it is preferred that V be included in a weight ratio in the range of 0.015 to 0.032 with respect to the iron group metal used as the binder-phase forming component.

The effect of the cemented carbide of the present invention is exhibited to its maximum when the above-described cemented carbide of the present invention is coated with a hard carbon coating and used as a material of a PCB drill having a cutting point diameter of 0.30 to 0.50 mm.

Having broadly portrayed the nature of the present invention, particular embodiments will now be described with reference to the accompanying drawing.

DETAILED DESCRIPTION OF THE PREFERRED EMBODIMENTS

Figure 1:
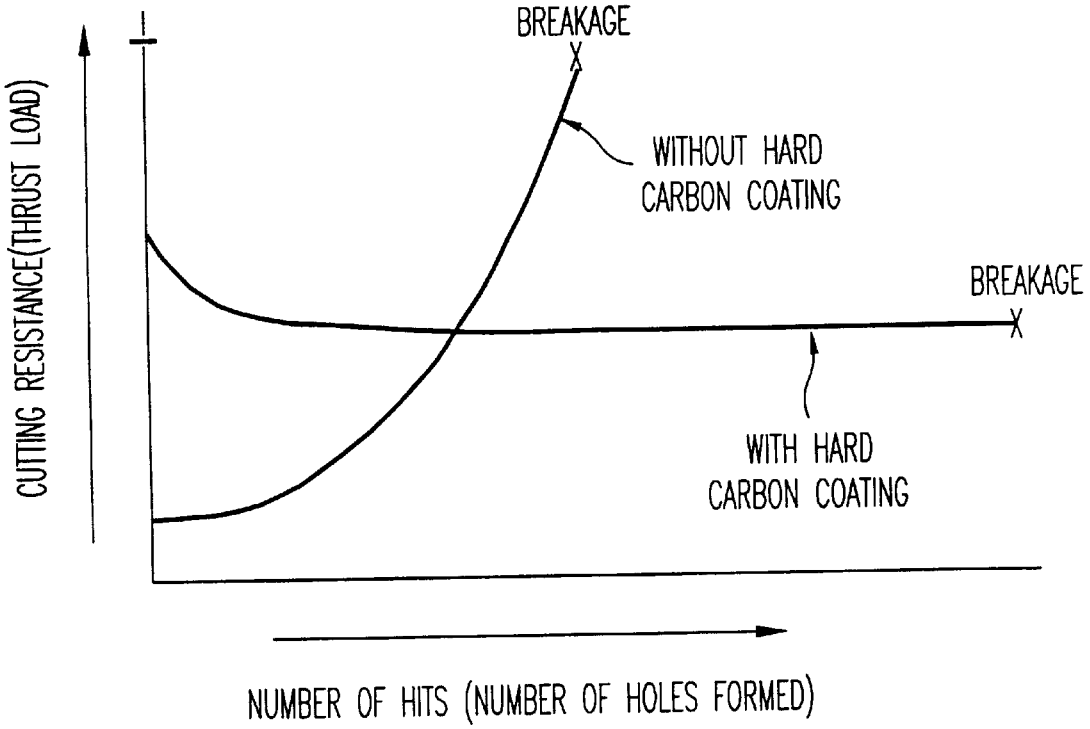
FIG. 1 is a graph showing the effect on the breakage of the drill of changes in the cutting resistance accompanying an increase in the number of drilling.

The inventors of the present invention carried out investigations into the changes in the cutting resistance accompanying an increase in the number of hits (number of times drill was used to form a hole), when holes are formed with a fine diameter PCB drill coated with a hard carbon coating, and having a cutting point diameter of ϕ0.5 mm or less, and compared the results with the case when a PCB drill having no hard carbon coating was used to form holes. The results are shown schematically in FIG. 1, and from these results the following inferences were made.

With PCB drills having no hard carbon coating, the wear of the cutting point of the drill progresses as the number of hits increases, and thus the cutting resistance increases rapidly and the drill breaks at about 2000 to 3000 hits. In contrast thereto, in the case of a PCB drill coated with a hard carbon coating, the cutting point of the drill loses some of its sharpness due to the coating. The cutting resistance is therefore high right from the start of the hole-forming operation, but since the wear of the hard carbon coating progresses only slowly even as the number of holes bored increases, the cutting resistance is maintained at its initial level until about 5000 to 6000 hits, and the drill suddenly breaks without any sudden increase in the cutting resistance.

On the basis of the above results, the inventors of the present invention carried out studies into cemented carbides which have excellent breakage resistance and excellent adhesion (with the hard carbon coating) when a hard carbon coating is formed on the surface thereof by chemical vapor deposition; and into the surface state of such cemented carbides.

As a result thereof, they found that, a cemented carbide which (i) has as its main component WC having an average grain size of 0.7 $\mu$m or less; (ii) includes 0.1 to 3.0 weight percent of one or more elements selected from the group of V, Cr, Ta and Mo; (iii) has had its surface modified in the way described hereunder; and (iv) has a Young's Modulus higher than a specific value, could be used to obtain a hard-carbon coated PCB drill which displays excellent properties with respect to the adhesion between the cemented carbide and the hard carbon coating and which displays excellent breakage resistance even after the formation of the hard-carbon coating.

The state of the modified surface of the cemented carbide here is one in which (A) the surface layer is consists of substantially only WC or only WC grains and components other than binder phase comprising iron group metals; and (B) the average grain size of the WC in the surface layer is even larger than the average grain size of the WC in the interior, etc.

Methods for modifying the surface of the cemented carbide in the above-mentioned way include heat treatment methods in which the outermost surface layer of the cemented carbide has its temperature raised to a temperature equal to or higher than the temperature at which the metal binder phase starts to melt. Such methods include those disclosed in for example Japanese Patent Application Publication No. Hei 7-11375 such as high frequency heating in a hydrogen atmosphere, exposure treatment in an atmosphere gas plasma, or DC pulse discharge treatment in an inert gas atmosphere. In these surface modifying methods, the energy supplied per unit area to the outermost surface is even more than the energy supplied when the cemented carbide is sintered, and thus even with cemented carbides which have been treated at the time of sintering such that there is no WC grain growth, it is possible to effect recrystallization and produce coarse grains with respect to only those WC grains in the outermost surface layer.

With the cemented carbide (for a drill) according to the present invention, the Young's Modulus in the interior is 600 MPa or higher, and thus the bend of the drill during hole-boring is small. This has the effect of suppressing the speed at which microcracks in the surface of the cemented carbide base material made brittle by the modifying treatment reach a size at which they become the cause of breakage of the drill itself, and as a result, a PCB drill cemented carbide having excellent breakage resistance can be obtained.

Furthermore, it is known that when specified amounts of V, Cr, Ta, Mo etc. are added to a WC-Co cemented carbide in the form of carbides, the growth of the WC grains is suppressed during the process of sintering, and that after sintering, one portion thereof dissolves into the iron group metals in the form of solid solution with the remaining portion becoming precipitated as a carbide phase. In the cemented carbide of the present invention, of all the above-described grain growth inhibitors, vanadium is precipitated as (W,V)C in such a manner that it fills the gaps formed between the WC grains in the surface layer of the base material by the surface modifying treatment, and acts to suppress the diffusion of iron group metals from the interior of the cemented carbide to the surface of the cemented carbide during the hard carbon coating. It is thereby possible to maintain an excellent level of adhesion between the cemented carbide and the hard carbon coating.

The reason why V exhibits the above-described kind of effect is not completely understood, but the following can probably be considered to be the reason. The amount of V which solidly dissolves in the iron group metal phase in the form of solid solution (for example, Co) is small compared to other WC grain growth inhibitors, and most of the V added does not dissolve in the binder phase but becomes precipitated in the form of (W,V)C. Furthermore, the precipitated form of the (W,V)C is similar to the precipitated form of the binder phase. Accordingly, when the surface is modified in order to eliminate iron group metals, the (W,V)C can become precipitated in such a way that it fills the gaps formed between the WC grains, and it is thought that it acts as a barrier which suppresses the diffusion of iron group metals from the interior of the cemented carbide to the surface of the cemented carbide during the subsequent step of forming the hard carbon coating.

Next, the reasons for the limits for the features of the cemented carbide (for a drill) of the present invention shall be explained. Firstly, it is required that the cemented carbide (for a drill) of the present invention have a Young's Modulus which is 600 MPa or higher. If the Young's Modulus is lower than 600 MPa, it is impossible to suppress the speed at which microcracks in the surface of the cemented carbide base material made brittle due to the modifying treatment grow to a size at which they cause breakage of the drill itself. It is preferred that the Young's Modulus be 610 MPa or higher.

The Young's Modulus of the cemented carbide is mainly fixed by the composition of the cemented carbide. When the content of WC grain growth inhibitors such as V, Cr, Ta and Mo is in the range of 0.1 to 3.0 weight percent as in the present invention, the Co content should be adjusted to 7 weight percent or less in order to make the Young's Modulus of the cemented carbide equal to 600 MPa or higher. The above-mentioned WC grain growth inhibitors are generally added in the form of carbides, and these generally exist in the cemented carbide in their original carbide form or in the form of a solid solution. In addition to V, Cr, Ta and Mo, Zr is also known as a WC grain growth inhibitors, but due to the fact that the addition of Zr can cause a deterioration in the sinterability and consequent striking reduction in the bending strength of the cemented carbide, it cannot be used for the cemented carbide in the present invention.

In the cemented carbide of the present invention, it is preferred that V be included in a weight ratio in the range of 0.015 to 0.032 with respect to the iron group metals. If the weight ratio is less than 0.015, there is almost no precipitation of (W,V)C between the WC in the surface layer of the base material at the time of surface modifying, with a consequent reduction in the effect of suppressing the diffusion of iron group metals from the interior of the cemented carbide to the surface of the cemented carbide when forming the hard carbon coating. On the other hand, if the above-mentioned weight ratio exceeds 0.032, the grain growth due to recrystallization of the WC in the surface layer at the time of surface modifying is strikingly suppressed, whereby the above-mentioned basic structure (B) cannot be achieved.

The basic structure of the cemented carbide used in the present invention is one in which the average grain size of the WC in the interior thereof is 0.7 μm or less. If this average grain size exceeds 0.7 μm, then the desired anti-breakage properties for the cemented carbide base material itself cannot be obtained. Furthermore, the cemented carbide of the present invention includes 0.1 to 3.0 weight percent of V, Cr, Ta, Mo etc. These components have the effect of suppressing the growth of the WC grains as mentioned above, and if their content is less than 0.1 weight percent, this effect is not sufficiently exhibited. If the content exceeds 3.0 weight percent, the carbides and solid solutions become coarse causing a reduction in the toughness and strength.

A PCB drill made by coating the above-described cemented carbide of the present invention with a hard carbon coating, and having a cutting point diameter in the range of 0.30 to 0.50 mm exhibits a performance superior to that of conventional PCB drills.

It has already been mentioned above that the cemented carbide of the present invention is not limited to ones having Co as the binder-phase forming component but may also include other iron group metals such as Ni. The use of Ni instead of Co can cause a striking reduction in the bending strength of the cemented carbide, and thus when Ni is used, it is preferred that it is used to replace a portion of the Co to the extent that there is no remarkable reduction of the bending strength.

Hereunder, several embodiments of the present invention shall be described. However, it should be noted that the present invention is not to be limited in any way by these examples, and that changes in form and detail may be made to the extent that they conform with the gist of the present invention as described hereabove and hereunder, and that such variations also lie within the technical scope of the present invention.

EXAMPLE 1

WC having an average grain size of 0.4 μm or 0.5 μm; Co having an average grain size of 1.3 μm; VC having an average grain size of 1.3 μm; $Cr_3C_2$ having an average grain size of 1.0 μm; and $Mo_2C$ having an average grain size of 2.0 μm were adopted as the powder raw materials, and these powder raw materials were mixed to form the compositions A to F shown in Table 1 below.

The mixture of powder raw materials was then mixed for 8 hours in an organic solvent using an attrition ball mill. This was followed by the addition of paraffin and drying. The dried mixture was then shaped by powder pressing at 100 MPa, followed by dewaxing and preliminary sintering. The pre-sintered product was then machine-cut into the required shape, followed by vacuum sintering for 1 hour at 1400° C. It was then subject to HIP treatment for 1 hour in an atmosphere of Ar at 100 MPa and 1350° C. to obtain the base material for a drill. The thus obtained base material had the properties shown in Table 2.

TABLE 1

| | Composition | | | | | | | |
|---|---|---|---|---|---|---|---|---|
| Drill Material | Co | VC (in terms of V) | $Cr_3C_2$ (in terms of Cr) | TaC (in terms of Ta) | $Mo_2C$ (in terms of Mo) | WC (AVGD: 0.5 μm) | WC (AVGD: 0.4 μm) | Weight ratio of V w.r.t Co |
| A | 5.0 | 0.15 (0.12) | 0.5 (0.43) | 0 | 0.5 (0.47) | Rest | — | 0.024 |
| B | 5.5 | 0.10 (0.08) | 0.5 (0.43) | 0.25 (0.23) | 0 | — | Rest | 0.015 |
| C | 9.0 | 0.30 (0.24) | 1.0 (0.87) | 0 | 0 | Rest | — | 0.027 |
| D | 12.0 | 0.35 (0.28) | 1.0 (0.87) | 0 | 0.8 (0.75) | Rest | — | 0.024 |
| E | 5.0 | 0 | 0.5 (0.43) | 0.3 (0.28) | 0 | — | Rest | 0 |
| F | 5.5 | 0.25 (0.207) | 0.5 (0.43) | 0 | 0 | Rest | — | 0.036 |

Note: AVGD is an abbreviation for average grain diameter.

TABLE 2

| Drill Material | AVGD of WC grains in interior | Young's Modulus (MPa) | Transverse Rupture (GPa) |
|---|---|---|---|
| A | 0.6 | 625 | 4.0 |
| B | 0.5 | 620 | 4.1 |
| C | 0.6 | 582 | 4.0 |
| D | 0.6 | 560 | 4.3 |
| E | 0.7 | 625 | 3.9 |
| F | 0.6 | 617 | 4.0 |

The drill base materials A to D were used to make PCB drill materials A to D (cutting point diameter: 0.40 mm). These PCB drill materials were treated for 5 minutes in a hydrogen plasma atmosphere, which was made by exciting hydrogen gas with microwaves, in such a way that only the tip reached a surface temperature of 1300° C., followed by further treatment for 2 minutes in a hydrogen/methane plasma, made by adding 0.2 volume percent of methane gas to the hydrogen gas.

The PCB drill materials A to D obtained in this way were adopted as inventive examples 1 and 2 and comparative examples 1 and 2 respectively. The distribution of Co in the surface and the average grain size of the WC grains in the surface layer after treatment were studied by electron probe microanalysis (EPMA) and scanning electron microscope (SEM) analysis. The results thereof are shown in Table 3.

TABLE 3

| | Drill Material | AVGD of WC grains in surface layer | Co remaining in surface layer |
|---|---|---|---|
| Inventive Example 1 | A | 1.1 | None |
| Inventive Example 2 | B | 1.2 | None |
| Comp. Example 1 | C | 1.1 | None |
| Comp. Example 2 | D | 1.1 | None |

Next, the PCB drill materials A to D which had been subjected to plasma treatment were immersed in a suspension of abrasive diamond grains (average grain size of about 0.3 μm) dispersed in ethanol, and then subjected to ultrasonic treatment. A hard carbon coating of a thickness of about 8.5 μm was then formed on the cutting point portion thereof by chemical vapor deposition for 7 hours with an excited methane-hydrogen gas mixture using a microwave plasma CVD method, to obtain 4 types of hard-carbon coated PCB drills. The conditions of synthesis were as follows:

Drill material temperature: 800° C.

Methane concentration: 2.5 volume percent.

The hard-carbon coated PCB drills of inventive examples 1 and 2 and comparative examples 1 and 2 were then used in a test in which holes were bored in a printed circuit boards. The cutting conditions were as follows:

Work material: 3 layer stack of glass-epoxy resin boards each having a thickness of 1.6 mm; Rotation speed: 80000 rpm; Feed rate: 2.8 m/min.

The result was that there was no observation of damage such as flaking of the coating for all 4 types of PCB drill up to 3000 hits. However, with comparative examples 1 and 2, the drill broke at 6500 and 5200 hits respectively. In contrast, with inventive examples 1 and 2, even after 50000 hits, there was no flaking of the coating and the shape of the bored holes was excellent It is thought that these results are due to the following: in comparison with the drills of inventive examples 1 and 2, the drills of comparative examples 1 and 2 comprise cemented base materials having a smaller Young's Modulus, and thus the bend of the drill when forming the holes became large, causing fast growth of the microcracks in the surface of the cemented carbide base material, which led to early breakage.

Example 2

The drill base materials A, B, E and F of Table 1 were used to produce PCB drill base materials A, B, E and F (cutting point diameter: 0.35 mm). These PCB drill base materials A, B, E, F were treated for 5 minutes in a plasma atmosphere, which was made by exciting hydrogen gas with microwaves, in such a way that only the tip reached a surface temperature of 1300° C., followed by further treatment for 2 minutes in a hydrogen/methane plasma, made by adding 0.2 volume percent of methane gas to the hydrogen gas.

The PCB drill materials A, B, E and F obtained in this way were adopted as inventive examples 3, 4, 5 and 6 respectively. The distribution of Co in the surface and the average grain size of the WC grains in the surface layer after treatment were studied by electron probe microanalysis (EPMA) and scanning electron microscope (SEM) analysis. The results thereof are shown in Table 4.

TABLE 4

| | Drill Material | AVGD of WC grains in surface layer | Co remaining in surface layer |
|---|---|---|---|
| Inventive Example 3 | A | 1.1 | None |
| Inventive Example 4 | B | 1.2 | None |
| Inventive Example 5 | E | 1.3 | None |
| Inventive Example 6 | F | 0.8 | None |

Next, the PCB drill materials A, B, E and F which had been subjected to plasma treatment were immersed in a suspension of abrasive diamond grains (average grain size of about 0.3 μm) dispersed in ethanol, and then subjected to ultrasonic treatment. A hard carbon coating of a thickness of about 7.5 μm was formed on the cutting point portion thereof by chemical vapor deposition for 7 hours with an excited methane-hydrogen gas mixture using a microwave plasma CVD method, to obtain 4 types of hard-carbon coated PCB drills. The conditions of synthesis were as follows:

Drill material temperature: 800° C.

Methane concentration: 2.0 volume percent.

The hard-carbon coated PCB drills of inventive examples 3 to 6 were then used in a test in which holes were bored in printed circuit boards. The cutting conditions were as follows:

Work material: 2 layer stack of glass-epoxy resin boards each having a thickness of 1.6 mm; Rotation speed: 75000 rpm; Feed rate: 2.4 m/min.

The result was that there was no observation of damage such as flaking of the coating for all 4 types of PCB drill up to 5000 hits. However, with inventive examples 5 and 6, peeling of the coating occurred at about 33000 and 27000 hits respectively. In inventive example 5, the content of vanadium with respect to the Co in the drill base material was low, and it is thought that this resulted in the amount of (W,V)C precipitated between the WC in the surface layer of the base material at the time of surface reforming becoming low; whereby the diffusion of Co from the interior of the cemented carbide to the surface of the cemented carbide at the time of forming the hard-carbon coating could not be completely suppressed; which in turn led to a low strength of adhesion between the surface of the base material and the coating; causing the coating to easily flake. In inventive example 6, the content of vanadium with respect to the Co in the drill base material had the high value of 0.036, and it is thought that this suppressed the growth of WC grains due to WC recrystallization in the outermost surface of the base material at the time of surface modifying, with the result that the gaps due to volatilization of Co existed between the grains in the outermost surface layer; which caused a reduction in the strength of the outermost surface layer of the base material and consequent flaking of the coating from the outermost surface layer of the base material. In contrast to these inventive examples, with inventive examples 3 and 4 which contained an appropriate amount of vanadium, there was no flaking of the coating and the shape of the bored holes was excellent even after 50000 hits.

The present invention has the construction described above, and makes it possible to produce (i) a cemented carbide for a hard-carbon coated PCB drill which has excellent breakage resistance and which displays good adhesion when coated with a hard-carbon coating, and (ii) a hard-carbon coated PCB drill having excellent breakage resistance which is made using said cemented carbide; and the present invention can thus be expected to one of extremely high industrial value.

While preferred embodiments of the present invention have been particularly shown and described, it will be understood by those skilled in the art that foregoing and other changes in form and detail may be made without departing from the spirit and scope of the present invention.

What is claimed is:

1. A WC-iron group metal(s) cemented carbide for a drill, comprising:

an interior, and a surface layer formed on the interior;

wherein the interior comprises as its main component WC having an average grain size of 0.7 $\mu$m or less and contains 0.1 to 3.0 weight percent of one or more selected from the group consisting of V, Cr, Ta and Mo;

wherein the surface layer consists of substantially only WC or only WC grains and components other than binder phase comprising iron group metals;

wherein the average grain size of the WC in the surface layer is larger than the average grain size of the WC in the interior; and wherein the Young's Modulus in the interior is 600 MPa or higher.

2. The cemented carbide for a drill according to claim 1 wherein the iron group metal(s) comprises Co.

3. The cemented carbide for a drill according to claim 2 wherein the content of Co is 7 weight percent or less.

4. The cemented carbide for a drill according to claim 2 wherein the iron group metal(s) further comprises Ni.

5. The cemented carbide for a drill according to claim 1 which comprises V in a weight ratio in the range of 0.015 to 0.032 with respect to said iron group metal(s).

6. The cemented carbide for a drill according to claim 2 which comprises V in a weight ratio in the range of 0.015 to 0.032 with respect to said iron group metal(s).

7. The cemented carbide according to claim 1 wherein the average grain size of the WC in the interior is 0.7 $\mu$m or less.

8. The cemented carbide according to claim 1, wherein the Young's Modulus of the interior is 610 MPa or more.

9. A drill for forming holes in printed circuit boards having a cutting point diameter of 0.30 to 0.50 mm and produced by the application of a hard-carbon coating to the surface of the cemented carbide according to any one of claims 1 to 8.

* * * * *

UNITED STATES PATENT AND TRADEMARK OFFICE

CERTIFICATE OF CORRECTION

PATENT NO. : 6,027,808
DATED : February 22, 2000
INVENTOR(S) : Yukio Aoki et al.

It is certified that error appears in the above-identified patent and that said Letters Patent is hereby corrected as shown below:

Title page, Item [54] and Column 1, lines 1-4,
Should read:
-- CEMENTED CARBIDE FOR A DRILL, AND A DRILL FOR FORMING HOLES IN PRINTED CIRCUIT BOARDS WHICH IS MADE OF THE CEMENTED CARBIDE --

Signed and Sealed this

Twenty-first Day of January, 2003

JAMES E. ROGAN
*Director of the United States Patent and Trademark Office*